United States Patent [19]

Pillsbury, Jr. et al.

[11] 4,140,003

[45] Feb. 20, 1979

[54] CIGARETTE SMOKING MACHINE

[75] Inventors: Harold C. Pillsbury, Jr., Rockville, Md.; Gerald L. Merfeld, Woodbridge, Va.; Leo G. Woerner, Towson, Md.

[73] Assignee: Federal Trade Commission, Washington, D.C.

[21] Appl. No.: 904,695

[22] Filed: May 10, 1978

[51] Int. Cl.[2] ..... G01N 1/26

[52] U.S. Cl. ..... 73/23

[58] Field of Search ..... 73/23, 28

[56] References Cited

U.S. PATENT DOCUMENTS

| | | | |
|---|---|---|---|
| 3,460,374 | 8/1969 | Parks | 73/23 |
| 3,528,435 | 9/1970 | Morrissey | 73/23 |
| 3,732,874 | 5/1973 | Wagner et al. | 73/23 |
| 4,019,366 | 4/1977 | Claflin | 73/23 |

*Primary Examiner*—Anthony V. Ciarlante

*Attorney, Agent, or Firm*—Sughrue, Rothwell, Mion, Zinn and Macpeak

[57] ABSTRACT

A sequential 20-port automatic smoking machine performing calibrated volume smoking of cigarettes is disclosed. The machine sequentially smokes 20 cigarettes for the collection and laboratory analysis of particulate matter and gas content of the cigarette smoke. Sequential smoking is accomplished by having each station take a 2-second puff every 3 seconds, yielding a 60-second cycle of time between puffs at each station. Control is electronic, utilizing solid-stage counters. Smoking syringes are individually operated by hydraulic cylinders in an even/odd arrangement of master drive cylinders both served by a common fluid reservoir. The master cylinders are disposed on opposite sides of the single crank system such that two halves are driven 180° out of phase. Gas lines connecting individual cigarette ports to the analyzers are purged with room air between each puff delivered to the respective analyzers. By use of sequential techniques, real time carbon monoxide (CO) measurements may be determined in addition to total particulate matter (TPM) collection.

15 Claims, 4 Drawing Figures

CIGARETTE SMOKING MACHINE

BACKGROUND OF THE INVENTION

This invention relates to an automated smoking machine for the collection and analysis of CO and TPM.

Machines to smoke cigarettes and analyze TPM have been used for many years to determine tar and nicotine levels. Within the industry, standard sample and analysis criteria have been established. Standards for puff volume, puff profile and puff duration, together with sample preparation and analysis, have been set by the U.S. Federal Trade Commission. Cigarette smoking machines must be built to produce puffs conforming to those standards, as set forth in, "Tar and Nicotine in Cigarette Smoke," Pillsbury, et al., *Journal of the Association of Official Analytical Chemists,* 52:458–462 (1969).

Such criteria provide a standard, uniform analytical technique to produce reproducible results between various testing laboratories for the determination of TPM and nicotine in cigarettes. In general, the standards provide for a puff volume of 35 ml measured as the volume of smoke that will be drawn from a cigarette per puff under actual machine smoking conditions. The duration of each puff is defined as being approximately 2 seconds, with the puff frequency of 1 puff per minute. By use of filters interposed between the cigarettes and the mechanism for generating a puff, the collection of TPM can be made.

A host of devices have been proposed and developed within the prior art. Typical machines for smoking cigarettes which are typified by U.S. Pat. Nos. 2,228,216 to Morgan; 3,200,648 to Waggaman; 3,433,054 to Mutter; 3,460,374 to Parks; 3,476,119 to Walton; 3,528,435 to Morrissey; 3,548,840 to Baumgartner; 3,548,841 to Caughui; 3,732,874 to Wagner, et al.; and 4,019,366 to Chalfin, et al. The hallmark of all of those devices is that they essentially deal with a parallel or all-at-a-time type of device. Hence, each cigarette in the group of 20 is puffed simultaneously once every 60 seconds, with TPM collected at each station. Such a device, while allowing for the adequate collection of TPM, cannot be used to deliver filtered gas from each discrete puff to a gas analyzer with minimum delay. Hence, determination of CO levels in such prior art machines is difficult, if not virtually impossible, to accomplish on a reliable and reproducible basis. Typical of such parallel-type machines is the automated 20-port smoking machine, Model 9900–100, manufactured by Phipps & Bird, Inc., Richmond, Va., which are discussed in the Pillsbury, et al. article.

The present invention is a specific improvement over the prior art parallel type of cigarette smoking machines.

SUMMARY OF THE INVENTION

The prior art parallel smoking machines allowed collection of TPM but made CO determinations on a real time basis difficult. The present invention utilizes a sequential smoking action beginning with a 2-second puff with a 3-second time frame at the first station, and then sequentially in identical time frames to the remaining 19 stations until the bank of 20 cigarettes is puffed. The duration for a complete cycle is 60 seconds, so the system repeats itself once each minute. This sequencing permits filtered gas of each discrete puff to be delivered to gas analyzers of the non-dispersive infrared (NDIR)

type with a minimum of delay, and involves only one gas handling valve per cigarette station.

Small diameter tubing and minature manifolds are used in the gas handling system between the smoking station and the analyzer. The lines, manifolds and analyzers are flushed with room air between each puff which is delivered to the analyzer.

A difficulty with prior art systems was their size, generally taking up valuable laboratory space and requiring bulky drive equipment. In contrast, the present invention is of considerably reduced size, with the entire device capable of table-top mounting and self-contained within a fume hood.

The present invention also differs from the prior art in the sense that it utilizes entirely electronic solid-state components. All switching to accomplish sequential valve operation is electronic, and puff count displays are made utilizing digital LED technology, therefore reducing the power requirements of the system.

The smoking machine utilizes low-cost, dry, plastic syringes which are individually operated by hydraulic cylinders, thereby permitting fine calibration adjustments, and resulting in a more compact design than in the parallel type of prior art equipment. The syringes are easily replaced, low in cost and can be calibrated to draw and expel the standard 35 ml puff volume. The syringes eliminate the need for oil, thereby avoiding problems of an oil/gas interface in the collection chamber. Also, dead space in the system is reduced by having a conical rubber tip on the syringe plunger. Additionally, by use of a special novel smoking port, standard filter holders may be placed on the machine in a simple plug-in fashion.

At each location, end-of-butt sensing is accomplished by means of thermistor sensors. This electronic type of sensor overcomes the material disadvantages of prior art trip wires and the like. Accurate end-of-butt determinations can be made on a standardized basis by utilizing electronic temperature-sensing techniques with a thermistor sensor. Positioning of the sensor can easily be made, and determination of end-of-butt length is done electronically, not relying on mechanical equipment subject to variations in output.

Accordingly, it is an object of this invention to provide for a novel sequential type of cigarette smoking machine.

It is another object of this invention to define a system which sequentially smokes 20 cigarettes in 2-second puff envelopes for real time CO gas determination as well as TPM collection.

A further object of this invention is to define a system in which gas lines, manifolds and analyzers may be flushed with room air between each puff delivered to the analyzers.

Yet another object of this invention is to define a parallel phase-opposed actuation system to sequentially smoke 20 cigarettes in an ultimate even/odd sequence.

A further object of this invention is to define a system in which electronic puff counts can be maintained together with an indication of overall station operation.

A still further object of this invention is to define a novel holder for filters which allow standard filter holders to be placed in the machine in a plug-in fashion with improved sealability from potentially contaminating outside environments.

These and other objects of this invention will become apparent and explained in greater detail in the accompanying drawings and Description of the Preferred Embodiment which follow.

DESCRIPTION OF THE PREFERRED EMBODIMENT

Figure 1:
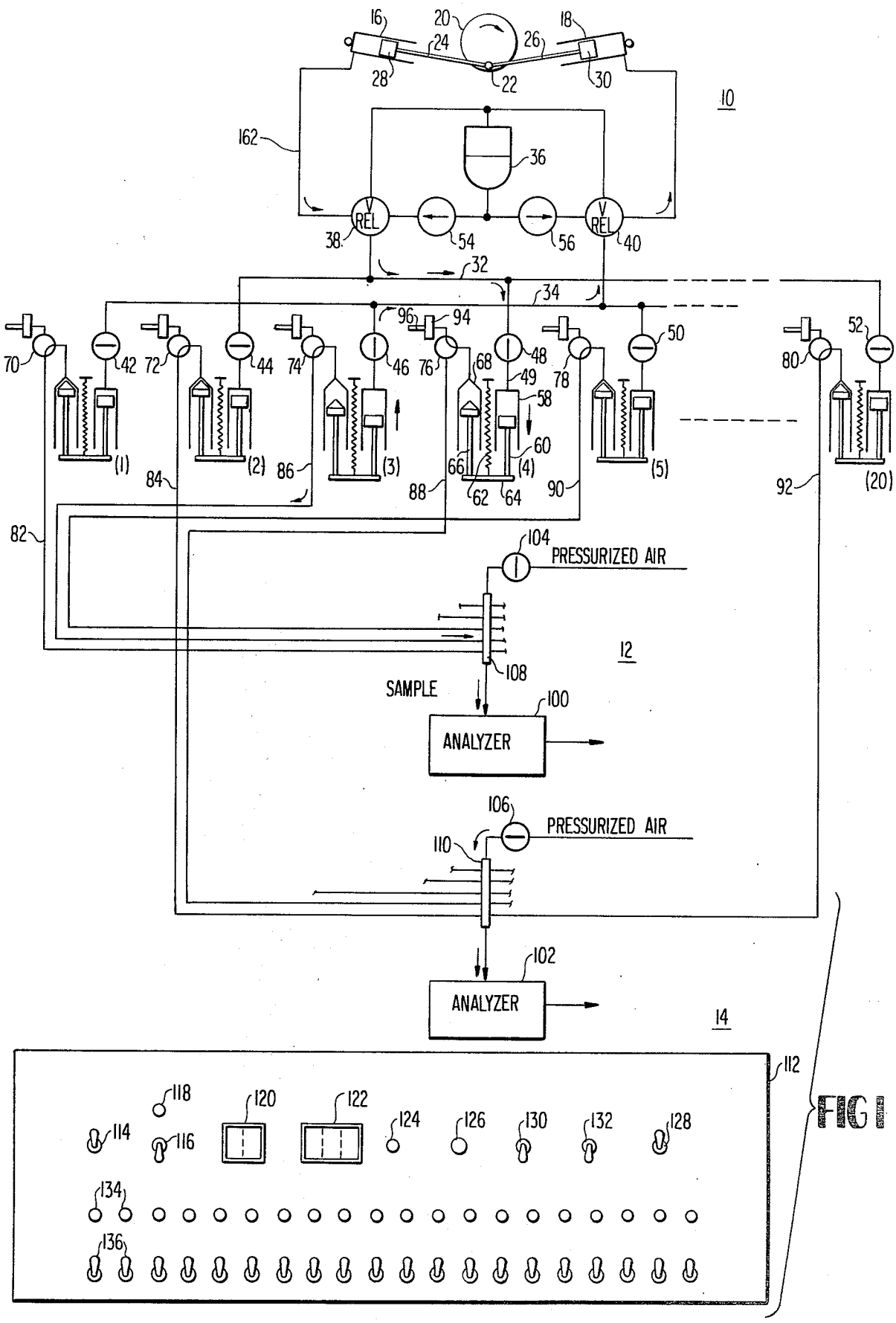
FIG. 1 is a schematic view showing the overall systematic components.

Referring now to FIG. 1, a schematic showing of the basic subsystem components of this invention is depicted. The invention broadly comprises three subsystems, a hydraulic system 10, a gas system 12 and an electronic subsystem 14. As previously indicated, the system has 20 stations which are positioned for sequential smoking of 20 cigarettes. As shown in FIG. 1, five such sequential stations are shown, with the 20th station designated by the number "20".

The hydraulic subsystem 10 functions to drive each of 20 syringes by sequential actuation in order to produce a puff volume, duration and frequency which is in accordance with standard recognized methods. The system broadly comprises two identical halves, with an even master cylinder 16 and an odd master cylinder 18. Each subsystem is symmetrical, with the master cylinders 16 and 18 being located on opposite sides of a single crank system 20 so that the two halves are driven 180° out of phase. The crank is driven by an electric motor or other such device to produce a uniform rotary output.

As shown schematically in FIG. 1, the crank 20 has a pin 22 coupling two piston rods 24 and 26 to the respective pistons 28 and 30 in the respective master cylinder. By such a technique, one master piston, for example, piston 28, will be fully extended as the second piston 30 is fully retracted. Hence, a single crank system is used to drive the two parallel hydraulic subsystems in a phase opposition manner.

As shown in FIG. 1, the "even" master cylinder 16 is coupled to each "even" slave cylinder via a fluid manifold 32. Hence, hydraulic fluid from the "even" fluid manifold 32 is used to systematically drive slave cylinders at stations 2, 4, 6, 8 . . . 20. In a like manner, the master cylinder 18 sequentially drives the "odd" slave cylinders via an "odd" fluid manifold 34.

Although the system operates with two independent parallel systems as shown in FIG. 1, a common hydraulic reservoir 36 is used. The "even" side of the system has a pressure-relief valve 38 associated with it, and, likewise, the "odd" system utilizes a similar valve 40. Associated with each station is a solenoid valve 42–52 interposed between the respective manifolds and the slave cylinders. Check valves 54 and 56 are used to insure an adequate supply of fluid into the respective halves of the hydraulic system. The reservoir 36 is arranged in actuality at the highest point in the hydraulic system to expel any air bubbles trapped by the relief valves 38 and 40 from that system. The system as designed is generally self-purging, with the exception of the master cylinder, and, accordingly, during operation, is operated for several cycles to insure that all air is purged therefrom.

The crank 20 is driven conventionally by an electric motor at a uniform rotational rate. As shown in FIG. 1, crank 20 will alternatively drive the "even" and "odd" master cylinders 16 and 18. For example, when the "even" master cylinder is in a power stroke and the appropriate solenoid valve 42 ∝ 52 is actuated, hydraulic fluid will pass through the manifold 32 to an appropriate slave cylinder.

As shown in FIG. 1, the slave cylinder comprises a cylinder chamber 58, having disposed therein a piston assembly 60 spring biased by means of spring member 62. When, for example, the solenoid 42 is actuated into an open position and the "odd" master cylinder 18 is in a power stroke, the slave piston 60 will be driven downwardly, and, by means of a mechanical arm 64, the corresponding syringe piston 66 in syringe module 68 will be driven downwardly, thereby performing an inhaling function. This is graphically shown in station 4. Although not shown, when the slave piston reaches the bottom of its stroke, it will contact a mechanical stop internal to the respective cylinder. It reaches this point at virtually the same time that its associated master cylinder reaches a full stroke level. Because the system is generally closed and, therefore, inelastic, at this point, a pressure spike will result and the respective relief valve 38 or 40 will be actuated. As the master cylinder retracts, the slave is directed upward by means of the tension spring member 62. These springs keep the hydraulic system under a positive pressure level by creating an impedance or bias against which the hydraulic system operates. They are shown in greater detail in FIG. 3.

As shown in FIG. 1, as indicated, station 4 is in the inhaling position, with the slave piston being driven downwardly, while, simultaneously, station 3 is in an exhaling mode, with the piston being driven upward.

When the slave piston reaches the top of its stroke, a mechanical stop is present, and, as in the case of the lower stroke condition, the master cylinder will reach its minimum stroke at nearly the same time. At this point in time, a small amount of fluid will be drawn into the system through the check valve 54 or 56 from the reservoir 36.

By facilitating a sequential inhale and exhale function, sequential operation of stations 1–20 is accomplished. At each station is a 3-way solenoid valve 70–80. The solenoid valves are operative by electronic control to couple each of the smoking ports alternatively to the associated syringe or to exhaust lines 82–92. As shown in FIG. 1, at the station 4 position, the solenoid valve 76 is coupled to the smoking station 94, having an associated cigarette 96. During the downward movement of the syringe, cigarette smoke is gated from the smoking station 94 through the solenoid 76 and into the syringe 68. Hence, an inhale of cigarette smoke is accomplished from the cigarette 96 to the syringe 68. During the exhale functions, as shown at station 3, the solenoid valve is cycled to couple the syringe to the output line, thereby exhaling smoke accumulated in the syringe into the output line 86 for analysis.

Gas analysis is accomplished via the gas subsystem 12 of this device. The function of the gas system is to, by virtue of the 20 smoking ports, sequentially inhale filtered smoke in measured 35 ml puffs, which correspond to the standard puff profile, and pass that inhaled gas in its entire volume to a respective analyzer. Conventionally, two analyzers 100 and 102 are used, each associated with the respective "even" and "odd" halves of the system. Those analyzers may be conventionally Beckman NDIR analyzers used to measure the percentage of CO in each puff. Results of the analysis are recorded on a station-by-station basis. Hence, two identical gas systems are used, each serving 10 sequentially-puffed cigarettes. The analyzer 100 is dedicated to the "odd" half of the system, while the analyzer 102 is dedicated to the "even" half. Strip recording may also be used.

Associated with each component half of the system is a source of pressurized air and a solenoid valve 104, 106 selectively gating pressurized air into a manifold 108, 110. At the end of each measuring cycle, air is introduced via the selected solenoid valve into the appropriate manifold and associated gas lines to purge the system, including the analyzer of all trapped gas. Hence, in between each measuring cycle, all gas lines starting from the manifold and the associated analyzer in each component half are purged with fresh air. The timing of this component of the overall operation will be described herein with respect to FIG. 4.

The third component subsystem is the electronic system 14 which utilizes the central control panel 112. The control panel is used to provide proper sequencing, display and memory capability governing entire system operation. A power switch 114 is used to control all input power into the system. A second toggle switch 116 functions as an inhibit counter switch, and, when actuated, a light 118 will indicate visually that the inhibit function is actuated. When the switch 116 is depressed while the equipment is running, the puff counter (to be described herein) will not accumulate for the next station following the one which is currently in operation at the time the switch is depressed. For example, if station 3 is displayed when the switch is depressed, then station 4 will operate normally except that no new puff count will be added to its accumulated reading during that cycle. This control is effective for a single cycle of one station only. As indicated, the pilot light 118 will indicate that the inhibit set and will reset after each station cycle. A visual display of the station which is inhaling is provided by indicator 120. This number will be displayed by LED display and will show a station which is in the inhale mode. For example, in FIG. 1, with station 4 in the inhale mode, the station display 120 would show "04".

A puff count register 122 is also employed, utilizing LED displays to show the accumulated puff count for the particular station displayed by display device 120. Puff count display 122 will read in tenths of puffs such that, when the station is puffing, it will show the tenth of a puff count as that particular puff proceeds. During the pause between puffs, the current puff count will be read since the counting will be accumulated to a total. Conventional solid-state memory elements are used to store puff counts for each station. When a cigarette has burned down to the end of smoking length such that an end-of-smoking-length signal is given, the puff counter will stop and will not accumulate any counts for future cycles until it has been reset by means of associated SMOKE SWITCH.

An indicator in the form of a pilot light 124 is used to provide a visual indication that normal operation is occurring and will not be illuminated when the last cigarette burns down or the system is stopped.

A push-button 126 is used when the machine is stopped to permit the operator to read out the accumulated puff count for any station. Displays will show the station number and puff count of the last station operated when a stop signal is given. A stop signal may be given by means of the toggle switch 128 which is selectively actuated into three modes, "SMOKE", "AUTO" and "STOP". When in a stop mode, depressing the button 126 will advance the display to the next station and show the corresponding puff count. Each time the step button is depressed, the display will advance to the next station. By continuously depressing the button 126, the display will index itself and display one station at a time until the button is released. The step button is biased to an inoperative function whenever the smoking indicator 124 is on.

A toggle switch 130 is used to provide a momentary contact switch as a convenience function to disable the next station. It is generally used when operation is with less than 20 cigarettes, and is momentarily depressed during a given station cycle to tell the equipment that the next station will be treated as though its cigarette had burned down. Hence, when this control is depressed, the decimal points in the station display 120 will come on to indicate that the next station has been turned off. Once a station has been latched off by depression of the toggle switch 130, the associated smoking valve will be rendered inoperative and the counter will not accumulate any puff counts for that station.

A reset toggle switch 132 is also used to provide a momentary contact which will return all counters, sensors and memories to a zero position. The toggle switch 128 is a 3-way operating control for normal cycling of the system. When it is set in an SMOKE mode, the drive motor associated with the crank 20 will run continuously even if all the cigarettes have burned down and no station is puffing. When it is in a second switch mode, AUTO, the motor will stop at the completion of the current puff cycle immediately after the last cigarette burns down. Whenever the switch is depressed into the momentary STOP position, the motor associated with the crank 20 will stop at the completion of the next cycle. When the machine has stopped in a normal manner, the switch will be in the AUTO position and the hydraulic motor system will be placed at the right dead center location ready to start again. When the system is then thrown to a SMOKE mode, the drive motor will go through half a cycle —that is, to left dead center and station 1 will start. If the switch is left in that position, the motor will continue to cycle until the switch is depressed to an STOP position momentarily. If, however, the switch is moved to an AUTO position, the machine will stop when the last cigarette has burned down.

As shown in FIG. 1, a series of indicator lights 134 are used to indicate the position of the counter of the corresponding station. If one of the lights 134 is on, the counter will accept counts, and if it is off, the counter is off, either because the cigarette has burned down or because the corresponding counter switch has been turned off.

In that regard, a series of counter switches 136 corresponding to each of 20 stations are shown in the control unit. They are normally in the "on" position for normal operation. If any switch is turned to the "off" position, the corresponding station will continue to puff normally, but the counter 122 will not accumulate puff counts until the individual switch is turned back to the on position.

By use of the electronic control unit 112 as described herein, a complete operation of the system, including valve sequencing, is effectuated. The operation allows for the sequential smoking of 20 cigarettes for collection and laboratory analysis of particular matter and gas content. As indicated, the gas content is delivered on a puff-by-puff basis to each of the gas analyzers 100 and 102 so that the CO content can be determined by means of those NDIR analyzers.

Figure 3:
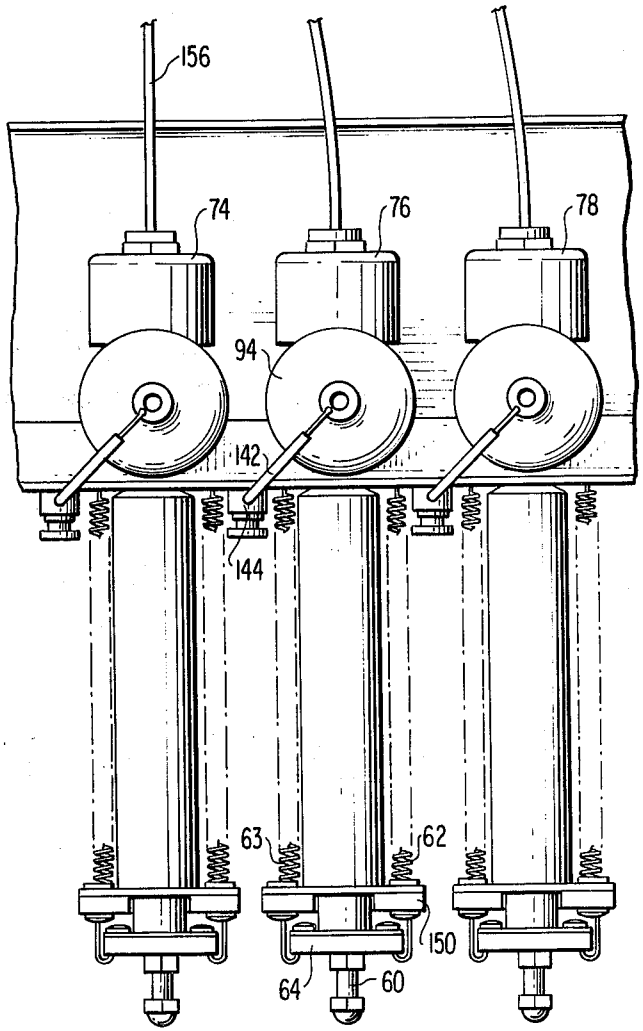
FIG. 3 is a front view showing three sections of the smoking machine in accordance with this invention.
Figure 2:
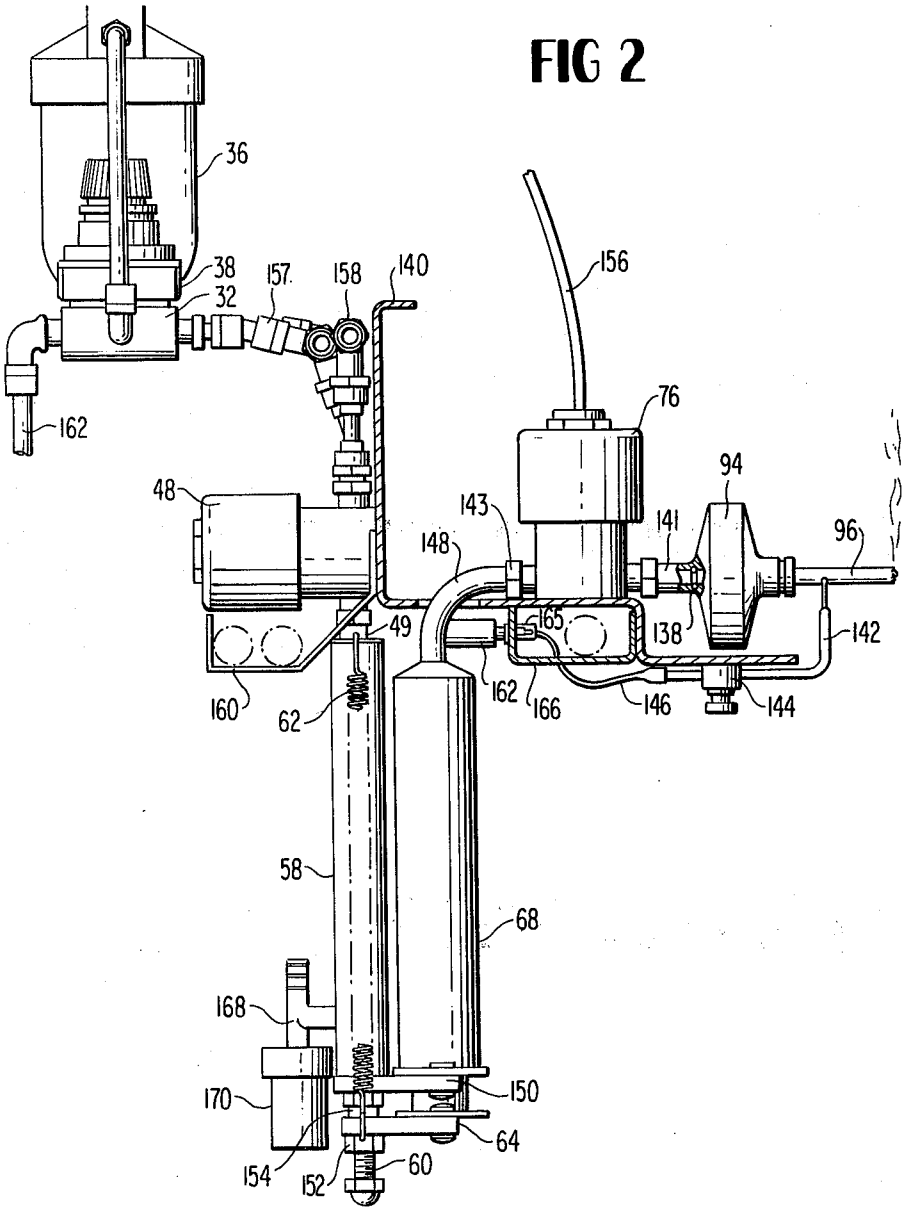
FIG. 2 is a side view of one section of the smoking apparatus of this system.

Referring now to FIGS. 2 adn 3, side and front views of typical sections of the cigarette smoking components are shown. As shown in those two figures, the stations are disposed on a side-by-side basis, each having a cigarette 96 placed in a cigarette holder 94. The holder 94 is configured to hold therein a filter element (not shown) which is used in the collection of TPM. The elements are replaced for each run, and this invention allows easy removal. As shown in FIG. 2, the filter holder uses an O-ring 138 which couples the holder element to a fitting 141. The O-ring provides an air-tight seal easily maintained for filter replacement. The solenoid 76 is mounted on a bracket plate 140 which forms the main frame of the smoking section of the machine. A thermistor sensor 142 is mounted, typically by screw mounting 144, into the bracket 140. The thermistor 142 is used to sense the butt mark end of a particular station. When the cigarette 96 burns down to the point that the threshold bias level of the thermistor 142 is reached, a signal is transmitted along leads 146 to the connect point 162, 165 forming a disconnect mounting, and then to the control module 112, thereby disabling that particular station. As shown in FIG. 2, the thermistors 142 are easily positioned by sliding horizontally in holder 144 to achieve a uniform butt end condition at all stations. A plug-type disconnect 162 is mounted on frame component 166, coupled to member 165. If a thermistor fails, it can be removed by means of mounting 144 and the quick electrical disconnect 162, 165 and replaced without rewiring those elements. As shown in FIG. 3, the thermistor can be reliably placed in the immediate vicinity of the cigarette such that accurate temperature sensing occurs without destruction of the thermistor itself. One thermistor per station is shown in FIG. 3.

When the smoking operation is complete, the filter holder 94 may be disconnected from the fitting 141 and the filter element therein removed for TPM analysis. By use of O-ring seals, such as O-ring 138, an accurate gas-tight system results and the filter is easily replaced.

As shown in FIG. 2, a section of tygon tubing 148 is used to couple the fitting 143 to the respective syringe 68. The syringe 68 is mounted on a support yoke 150, with the coupling plate 64 fixedly attached to the inner syringe element. The coupling plate 64 is attached to the piston rod 60 of the slave cylinder, and, as shown, a jam nut 152 is used to couple the coupling plate 64 securely to the piston rod. Although not shown, a lock washer may be interposed, and the spring element 62 may terminate in the jam nut fitting.

Puff volume is determined by the stroke of the slave cylinder, and, at its upper limit, a washer 154 touches the cylinder bushing. The thickness of this washer is selected so that at the top position, the syringe is exhausted but its plunger is not touching the top of the syringe body.

The lower limit is set by the position of the threaded coupling plate 64 and the threaded piston rod 60. The piston rod 60 is rotated to alter this position, and once set, the jam nut 152 is tighted to define that limit of travel. A plastic tee 168 serves as a conduit for hydraulic fluid which is forced past the piston head (leakage). The upper end serves as an air release, and the lower end feeds the reservoir 170 holding seepage from the slave cylinders.

As shown in FIG. 2, the 3-way solenoid 76 is disposed in a position intermediate of the syringe 68 and the filter 94. Tubing 156 feeds the exhausted gas to the respective manifold. Operation of the solenoid 76 selectively gates cigarette smoke into the syringe 68 during the downward stroke of the piston rod 60 when the particular station is sequentially sampled. The solenoid 76 is operative into a second position to expel inhaled gas into the analyzer as the piston rod 60 moves upward to its upper limit. At all other times when other stations are sampled, the valve remains off, disabling the slave cylinder at that station.

As shown in FIG. 2, the reservoir 36 is coupled to the relief valve 38 by high-pressure tubing. The reservoir may be coupled to the frame 140 by a bracket or other structural element not shown. The relief valve 38, by means of pressure couplings, provides a source of fluid flow into the manifold 32 and thence, by appropriate coupling 157, 158, to the respective solenoid valve associated with each station. Line 162 couples the relief valve 38 to the master cylinder 16. FIG. 2 shows solenoid valve 48 which is used to selectively gate fluid into the slave piston for that smoking station. The solenoid valve 48 is mounted on a bracket element 160 coupled to the frame 140 by any convenient technique. Pressure section 49 couples valve 48 to slave cylinder 58 to pump hydraulic fluid into that cylinder.

As shown in FIG. 3, each smoking station is identical, and the syringe is positively biased by two springs 62 and 63 to provide a uniform biasing force on each side of the syringe internal piston. Also, the position of the thermistor relative to each cigarette is shown.

Figure 4:
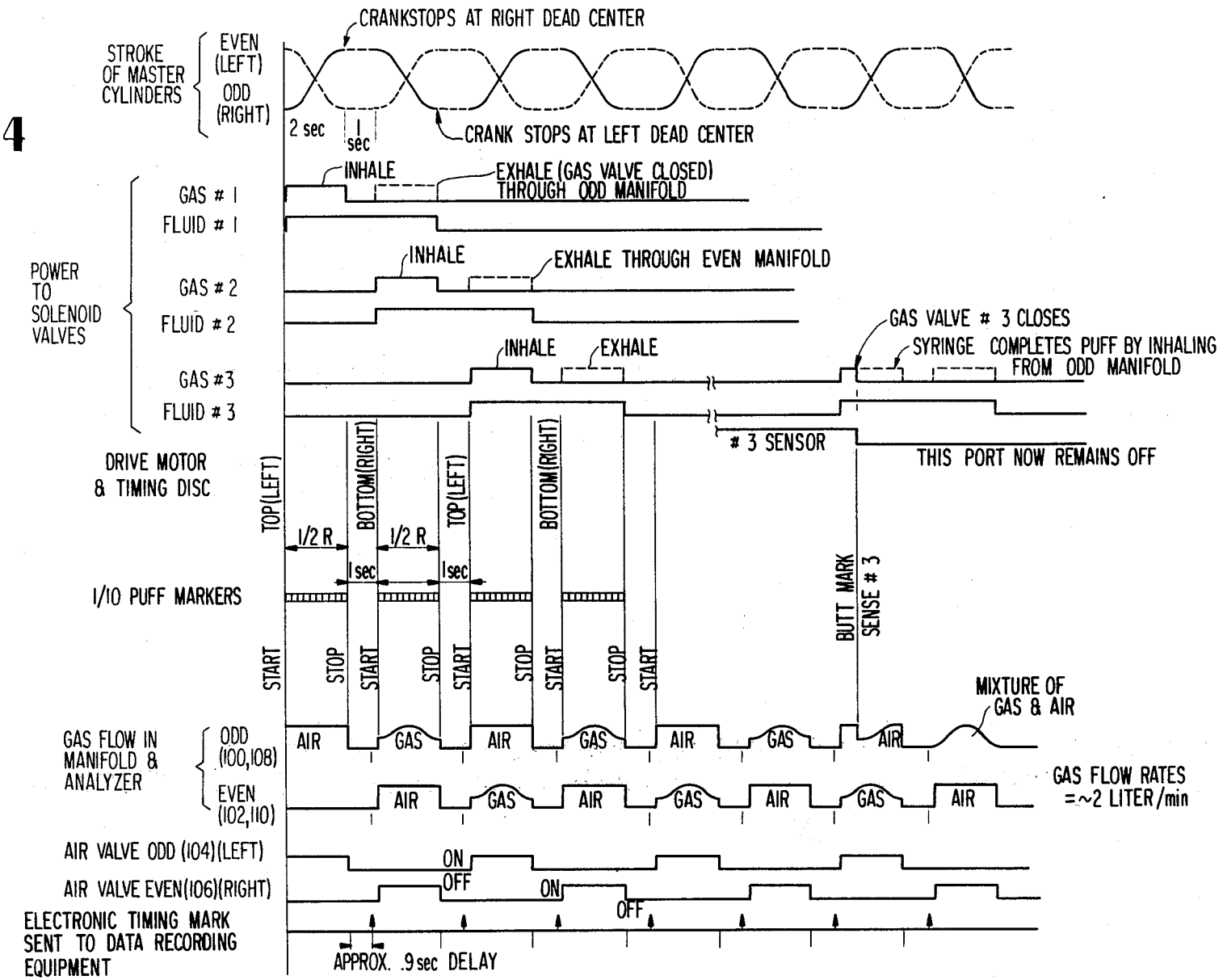
FIG. 4 is a timing diagram showing systematic operation of the cigarette machine.

Referring now to FIG. 4, the operation of the system in terms of timing logic will be shown. System timing is accomplished in a dual mode by means of two subsystems, the master cylinder drive 20–26 shown in FIG. 1 and a time delay network in the electronic control package of the electronic control 112. As the system sequentially actuates, control passes back and forth between these two subsystems. The master cylinder provides the basic period and the electronic control appropriate indexing to effectuate sequential sampling.

With 20 cigarettes mounted, one in each station, and appropriate filter elements placed in each filter holder 94, the electronic control will first instruct the drive motor to start, thereby rotating the crank 20. The upper curves in FIG. 4 show the 180° out-of-phase rotation of the crank wherein the strokes of the master cylinder are shown in an even/odd phase-opposed mode of operation. The timing curves for the strokes of the master cylinders, as shown in FIG. 1, delineate a cycle portion, a 1-second wait period occurs followed by a 2-second exhale period. A 1-second gap then occurs, and then at the next N + 2 station, the syringe will start its cycle. Hence, as shown in the upper two curves of FIG. 4, an even/odd 3second repetitive cycle occurs in the system. With the complete repetition rate of 6 seconds per cycle, given 10 syringes in each subsystem, the entire operation will sequence once each minute. As shown in FIG. 4, inhaling and exhaling are phase operations at adjacent stations.

The electronic control is first actuated to instruct the drive motor to begin operation of the crank, and a timing disc associated with the crank (not shown), together with photosensors, will produce evenly spaced pulses on a tenth of a second basis for the puff counter 122.

This tenth of a second puff counting from the timing disc is done by conventional encoding techniques which need not be discussed herein.

As shown in the second set of curves which provide timing diagrams of power to the solenoid valves, a sequence of operation for the first three stations is shown. Immediately below those timing diagrams, the tenth of a second puff markers and the sequence of the timing disc on the drive motor are shown. These timing diagrams are all appropriately sequenced to the stroke of the master cylinder shown in the upper portion of FIG. 4.

Typically, at the fourth station, the solenoid valve 76 is actuated, and for 2 seconds, an inhale sequence commences as the slave cylinder 58 with piston 60 is driven downward, thereby drawing the syringe piston 66 in a downward or inhale mode. Simultaneously, as the syringe begins to extend downwardly for 2 seconds, a 35 ml uniform volume will be drawn through the filter element 94 from the cigarette and into the syringe. For each station, at the end of the 2-second inhale cycle, the syringe will reach the bottom limit and stop and remain there for 1 second. During this 1-second period, turbulence within the syringe will completely mix the gas.

The gas solenoid 76 will then be de-energized and the valve switched to connect the syringe through the tubing 88 to the manifold 110. Following the 1-second wait period, the syringe 66 will begin its upward or retract cycle, thereby exhaling the 35 ml volume through tube 88, through the manifold and into the IR measuring cell 102.

As shown in FIG. 4, during the exhale cycle of station 1, an inhale cycle of station 2, the compatible opposite half of the system, is occurring. Also shown is the gas flow in the manifold and analyzer during the exhale portion of station 1 such that gas is delivered through the manifold to the analyzer.

The system utilizes small volume tubing such that the volume of the manifold and the connecting tube is less than 4 ml. During the second 2-second interval in which the exhale cycle in station 1 occurs, 35 ml of gas will sweep through the small manifold and into the IR cell. At the end of that 2-second period, the syringe has reached the top of its stroke and stops.

As shown in FIG. 4, during the next 1-second period, there is no movement. During this time, gas pressure will equalize itself and the IR analyzer 100 will stabilize its reading. As shown in the tenth puff marker digits, when nine-tenths of this 1-second has passed, the control signal will send out a marker signal through connectors to indicate that the analyzer output should be read. At that point in time, the CO content of that puff may be recorded from the analyzer 100.

At this point in time, 6 seconds or one complete cycle has been completed, and the next valve, No. 3, will begin to inhale. Simultaneously, with the inhaling of a given syringe, the air valve in the same system is turned on —that is, when no gas is being sent to the manifold— thereby sweeping the manifold, lines and IR cell with fresh air. FIG. 4 shows the sequencing of the air valves in the odd and even arrangement —that is, the valves 104 and 106— such that a sweeping occurs by the square wave AIR curves for the "odd" and "even" systems shown in FIG. 4 through the manifold and analyzer.

At the end of 2 seconds, the appropriate air valve will be shut off, and then 0.9 seconds later, the opposite IR cell meter should be at a zero level. The result of this is that each meter receives first a 2-second burst of gas followed by a 1-second pause, then followed by a 2-second burst of fresh air and a 1-second pause, then followed by a 2-second burst of gas from the N + 2 station. The curves showing the gas flow in the manifold and analyzer delineate this air, pause, gas, pause, air, sequencing in each manifold and analyzer. Accordingly, gas from any two cigarettes is never mixed. This is clearly shown again in the curves of FIG. 4. Each IR meter automatically returns to zero following each reading for each cigarette.

As shown in FIG. 4, with respect to station 3, following the broken lines, the number 3 station —that is, the end-of-butt thermistor 142— will generate and end-of-butt signal during inhale and the gas valve will immediately be turned off as shown. Although the syringe completes the puff by inhaling, the remainder of the inhale puff is supplied by purge air, and the gas in the syringe will be diluted. Hence, the CO reading will be reduced proportionately to the amount of puff which occurred after the cigarette has burned down. As shown in the curve for the third station following an end-of-butt signal, the port will remain off for the remainder of the run.

Accordingly, as shown in FIG. 4, the system of this invention works by a sequential smoking of cigarettes from two identical, oppositely-sampled subsystems. The two even/odd subsystems are independent and are driven completely 180° out of phase with each other. By this manner, not only can TPM analysis be made of each individual cigarette but, also, real time CO sampling can be made on a puff-by-puff basis for each cigarette sampled. When the last cigarette has burned down, the smoking indicator 124 will go out, and if the machine is operated in an automatic mode, it will stop itself. If operated in a smoke or manual mode, switch 128 will be depressed to stop to complete sequencing of the machine. At this point in time, the cigarette butts may be removed and the filters from filter holders 94 removed for TPM analysis.

It is readily apparent that modifications and additions to various components may be effectuated without departing from the essential scope of this invention. Hence, although a crank system utilizing master cylinders is shown, it is readily apparent that other types of drive systems may be used to effectuate an ultimate, 180° out-of-phase mode of operation. Various recording techniques may be used, such as strip recorders, computer stored inputs from the analyzers and the like.

Having described our invention, we claim:

1. Apparatus for smoking cigarettes comprising means for respectively mounting at least first and second cigarettes, and means coupled to said mounting means to sequentially draw and collect smoke from said first cigarette while expelling collected smoke from said second cigarette, and then draw and collect smoke from said second cigarette while expelling collected smoke from said first cigarette.

2. The apparatus of claim 1 wherein said means to sequentially draw and collect smoke comprises means rotating at a constant speed, and first and second master cylinders coupled to said rotating means, said first and second master cylinders being driven 180° out of phase, and means coupling one of said master cylinders to said means for mounting said first cigarette and coupling the second of said master cylinders to said means for mounting said second cigarette.

3. The apparatus of claim 2 wherein said coupling means comprises a slave piston and cylinder in fluid communication with one of said master cylinders, a syringe having a plunger section, said slave piston linked to said plunger section to effectuate identical reciprocating motion.

4. The apparatus of claim 3 further comprising valve means interposed between said master cylinder and said slave cylinder and timing means to selectively open said valve, said timing means including display means.

5. The apparatus of claim 4 further comprising additional valve means interposed between said syringe and said mounting means for said first cigarette, said timing means selectively actuating said additional valve means to draw cigarette smoke from said first cigarette into said syringe during motion of said plunger in one direction and to expel smoke from said syringe during motion of said plunger in an opposite direction.

6. The apparatus of claim 5 further comprising an output line coupled to said additional valve means and analyzer means coupled to said output line to measure CO content from cigarette smoke after it is being expelled from said syringe.

7. The apparatus of claim 6 further comprising means to purge said analyzer and output line of cigarette smoke.

8. The apparatus of claim 1 further comprising electronic means disposed on said mounting to sense when each of said cigarette has reached a predetermined length.

9. The apparatus of claim 8 further comprising switch means responsive to said electronic sensing means to disconnect said means to sequentially draw smoke from the respective cigarette when it has reached said predetermined length.

10. The apparatus of claim 1 wherein said mounting further includes a holder adapted to support a filter element between a cigarette and said means to sequentially draw smoke, said cigarette being mounted in said holder.

11. In a machine for smoking a plurality of cigarettes, the machine has means to hold said cigarettes in an even number of smoking stations, means to collect particulate matter in said smoke at each of said stations, and hydraulic means to define a puff and exhale smoking cycle, the improvement comprising said machine divided into two substantially equal suubsystems, and means for sequentially puffing a cigarette at a station from one subsystem and then from a station in the other subsystem.

12. The machine of claim 11 wherein cigarettes are sequentially smoked, further comprising means for puffing a cigarette in one subsystem while similtaneously exhaling smoke from a cigarette in the other subsystem.

13. The machine of claim 12 further comprising means to purge a portion of one subsystem when a cigarette in that subsystem is being puffed.

14. The machine of claim 12 further including analyzer means associated with each subsystem and means to gate exhaled smoke from a cigarette to said analyzer means for real time CO measurement.

15. The machine of claim 14 further comprising means to display the puff count for each station and to indicate in real time which station is being sequentially smoked.

* * * * *